United States Patent [19]

Iiyama et al.

[11] 3,967,600

[45] July 6, 1976

[54] CARBURETOR CHOKE CONTROL DEVICE

[75] Inventors: Masahiko Iiyama; Takashi Kamezaki, both of Tokyo, Japan

[73] Assignee: Honda Giken Kogyo Kabushiki Kaisha, Tokyo, Japan

[22] Filed: Nov. 1, 1974

[21] Appl. No.: 520,006

[30] Foreign Application Priority Data

Nov. 7, 1973 Japan ..... 48-125212

[52] U.S. Cl. ..... 123/75 B; 123/119 F; 123/127; 123/DIG. 4; 261/23 A

[51] Int. Cl.[2] ..... F02M 25/06

[58] Field of Search ..... 261/23 A; 123/119 F, 123/32 ST, 127, 75 B, DIG. 4, 179 G

[56] References Cited

UNITED STATES PATENTS

| | | | |
|---|---|---|---|
| 3,443,552 | 5/1969 | Von Seggern et al. | 123/75 B |
| 3,659,564 | 5/1972 | Suzuki et al. | 261/23 A |
| 3,785,624 | 1/1974 | Marsee | 261/23 A |
| 3,837,322 | 9/1974 | Shishido et al. | 123/119 F |

*Primary Examiner*—Charles J. Myhre
*Assistant Examiner*—Sheldon Richter
*Attorney, Agent, or Firm*—Lyon & Lyon

[57] ABSTRACT

A choke valve control device is provided for an internal combustion piston engine in which each cylinder is provided with a main combustion chamber and an auxiliary combustion chamber connected by a torch nozzle. A first carburetor supplies lean mixture to the main chamber and a second carburetor supplies rich mixture to the auxiliary chamber, and each carburetor is provided with a choke valve. The choke valve of the first carburetor may be automatically operated by means of a bimetal element or may be manually actuated. Both choke valves are provided with biasing means tending to move them toward closed position, respectively, and each is provided with valve opening means responsive to engine operation.

13 Claims, 2 Drawing Figures

CARBURETOR CHOKE CONTROL DEVICE

This invention relates to internal combustion piston engines of the type in which each cylinder has a main combustion chamber and an auxiliary combustion chamber connected by a torch nozzle. A lean mixture is delivered by a first carburetor to the main combustion chamber and a rich mixture is delivered by an auxiliary carburetor to the auxiliary combustion chamber. A spark plug ignites the mixture in the auxiliary chamber at the end of the compression stroke and the resulting flame passes through the torch nozzle to burn the lean mixture in the main chamber. Each of the carburetors is provided with a throttle valve and a choke valve, and this invention contemplates the provision of a novel form of control device for both choke valves, particularly for starting the engine under low temperature conditions.

In the past, cold starting of internal combustion engines of this type depended upon good electrical ignitability of the rich mixture for the auxiliary chamber by the provision of a choke valve only for the lean mixture produced by the main carburetor. But since vaporization of the fuel becomes extremely poor under cold start conditions, the fuel loss due to condensation of the fuel on the walls of the intake pipe and the walls of the combustion chambers is severe. When the ambient temperature of the engine falls below −20°C the mixture inside the auxiliary combustion chamber may become too lean, and the engine becomes difficult to start.

It is an object of this invention to provide a choke control device which will improve the starting characteristics of the engine under extreme cold weather conditions, as well as to reduce the content of the unburned components of the exhaust gas by suitably resetting the air-fuel ratio automatically when the engine begins to turn its own power.

Other and more detailed object and advantages will appear hereinafter.

Figure 1:
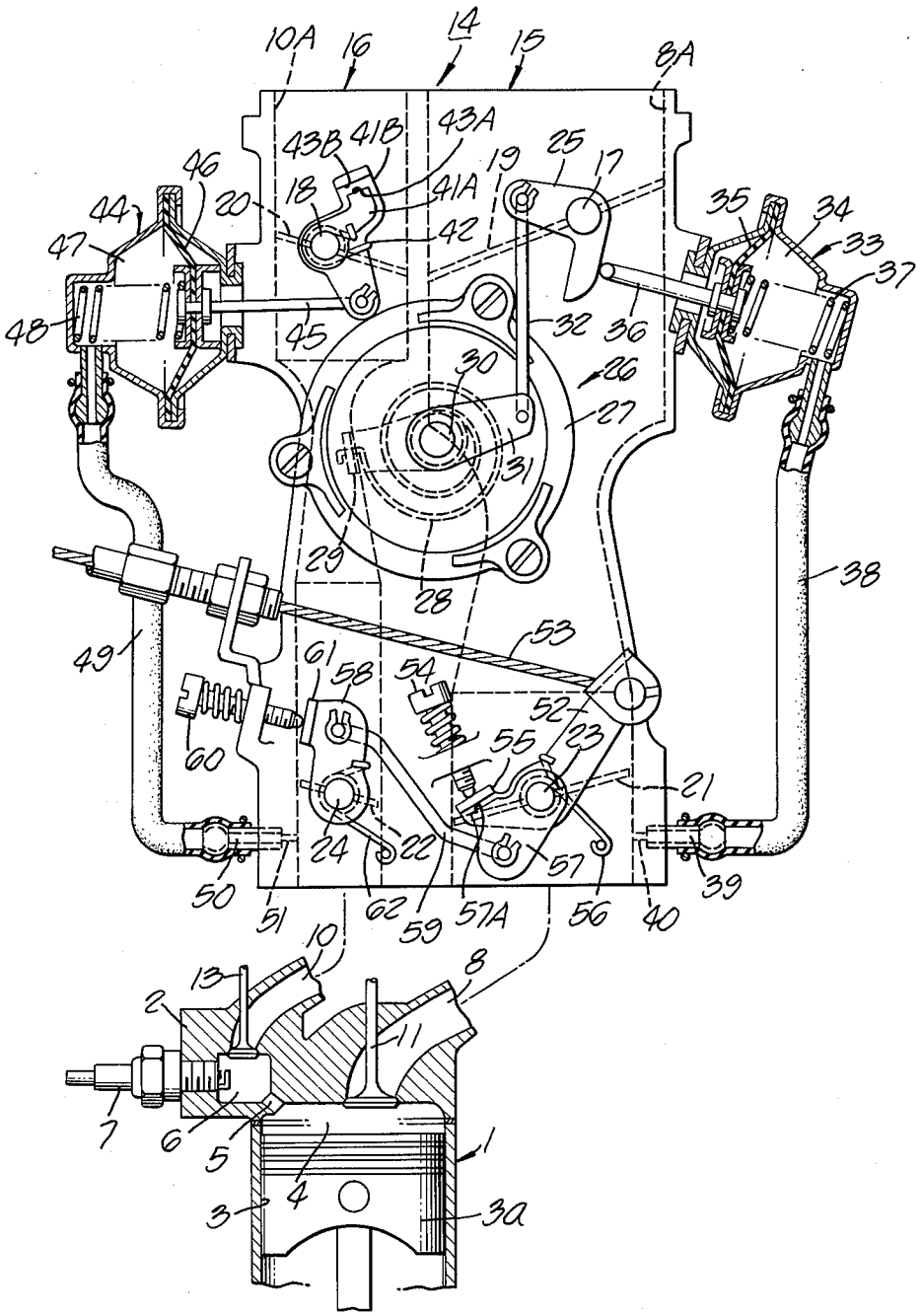
FIG. 1 is a side elevation partly in section showing a preferred embodiment of this invention, and relating to an automatic choke device.

Referring to the drawings, the engine body shown diagrammatically at 1 has a head 2 closing the upper end of the cylinder 3 and cooperating with the piston 3*a* to form a main combustion chamber 4. A torch nozzle 5 connects the auxiliary combustion chamber 6 with the main combustion chamber 4. A spark plug 7 is positioned to ignite the mixture in the auxiliary chamber 6.

Lean mixture is delivered through the intake passage 8 to the main chamber 4, controlled by the intake valve 11. Similarly, rich mixture is delivered through the auxiliary intake passage 10 to the auxiliary chamber 6, controlled by the auxiliary intake valve 13. An exhaust valve (not shown) controls the discharge of exhaust gases from the main combustion chamber 4. All of the valves are operated in timed sequence by conventional means, not shown.

In accordance with this invention, a carburetor assembly generally designated 14 is provided for supplying a lean mixture to the main intake passage 8 and a rich mixture to the auxiliary intake passage 10. The assembly 14 comprises a lean mixture carburetor 15 having a main intake conduit 8A connected to the main intake passage 8, and a rich mixture carburetor 16 having an auxiliary intake conduit 10A connected to the auxiliary intake passage 10. A choke valve shaft 17 extends across the conduit 8A and another choke shaft 18 extends across the auxiliary conduit 10A. The shaft 17 provides an off-center turnable support for the choke valve 19, and the shaft 18 provides a similar support for the choke valve 20. When the engine is running, the intake vacuum pressure acts to open the choke valve 19 in a counterclockwise direction and acts to open the auxiliary choke valve 20 in a clockwise direction.

The main throttle valve 21 ismounted in the conduit 8A below the main choke valve is mounted and similarly the auxiliary throttle valve 22 is mounted in the auxiliary conduit 10A below the auxiliary choke valve 20. A throttle valve 21 is fixed to the shaft 23 and the throttle valve 22 is fixed to the shaft 24.

A main lever 25 in the shape of a bell crank is fastened to the projecting end of the shaft 17 and is operated by a bimetallic choke valve regulating device generally designated 26. This device includes a control box 27 which houses a spiral bimetal 28 and an electric heater (not shown) which heats the bimetal 28 when the engine is running. The outside end of the spiral bimetal 28 is connected to the stationary part 29 attached to the inside of the control box 27. The inside end of the spiral bimetal 28 is connected to the shaft 30 which is supported to turn at the center of the control box 27. A drive crank 31 is fastened to the projecting end of the shaft 30 and is connected to one end of the main choke lever 25 through the connecting rod 32. When the engine is not running, the temperature inside the control box 27 is influenced by the engine ambient temperature. When the engine is running, however, the temperature inside the control box is regulated by the electric heater (not shown) and the bimetal 28 is deformed in such a manner that a rise in the internal temperature of the control box 27 is accompanied by opening movement of the main choke valve 19 in a counterclockwise direction.

A main vacuum pressure operating device 33 is installed on one side of the carburetor assembly 14 and it supports an operating rod 36 which is fastened to the center of the operating diaphragm 35 which forms one side of the vacuum chamber 34. The extending end of the rod 36 is positioned to contact the lever 25 at a location remote from its connection to the rod 32. A compression spring 37 within the vacuum chamber 34 acts in a direction to move the choke valve 19 in the closing direction (clockwise) against the resilient force of the bimetal 28. One end of the vacuum signal tube 38 is connected to the vacuum chamber 34 and the other end of this tube is connected to the pipe 39 and orifice 40 to the interior of the conduit 8A downstream from the main throttle valve 21.

The auxiliary choke lever 41A is secured to the shaft 18 of the auxiliary choke valve 20 and the choke lever 41B is mounted to turn on the shaft 18. Both levers 41A and 41B are coupled by means of the torsion spring 42, and the surface 43A is faced with the shoulder 43B. The auxiliary vacuum pressure operating device 44 is installed at the other side of the carburetor assembly 14 and the operating rod 45 is pivotally connected to the auxiliary choke lever 41B. The operating rod 45 is fixed to the center of the flexible diaphragm 46 which forms one side of the vacuum chamber 47. The compression spring 48 normally urges the diaphragm 46 to move in a direction to close the auxiliary choke valve 20 by counterclockwise motion. One end of the vacuum signal tube 49 is connected to the vacuum chamber 47, and the other end of this tube is connected to the pipe 50 and orifice 51 to the interior of the passage 10A downstream from the auxiliary throttle valve 22.

The main throttle lever 52 secured to the projecting end of the throttle valve shaft 23 is operated by means of a wire 53 connected to one end of the lever 52. The adjustable set screw 54 engages the shoulder 55 on the lever 52, to limit the extent of clockwise movement thereof against the action of the torsion spring 56. The cooperating lever 57 is mounted to turn on the throttle valve shaft 23 and is connected by the rod 59 to the auxiliary throttle lever 58. This lever 58 is fixed to the projecting end of the shaft 24 which is fixed to the auxiliary throttle valve 22. A shoulder 61 on the auxiliary throttle lever 58 is engaged by the adjustable set screw 60. A torsion spring 62 acts to move the auxiliary throttle lever 58 in a counterclockwise direction to engage the set screw 60. The shoulder 55 is engaged by the surface 57A of the lever 57 when the main throttle lever 52 is turned by the pull of the operating wire 53, and this causes the auxiliary throttle lever 58 and the auxiliary throttle 22 to move clockwise in an opening direction. Accordingly, the main and auxiliary throttle valves 21 and 22 can be opened simultaneously.

In operation, and when the engine is running under normal conditions, a lean mixture is produced in the main carburetor 15 and a rich mixture is produced in the auxiliary carburetor 16, and on the suction stroke these mixtures are drawn into the main and auxiliary chambers 4 and 6 through the main auxiliary intake passages 8 and 10. On the compression stroke, the rich mixture is diluted to some extent by reverse flow through the torch nozzle 5 from the main chamber 4 into the auxiliary chamber 6. The air-fuel ratio of this suitably diluted mixture in the auxiliary chamber is ideal for easy ingition by the spark plug at the end of the compression stroke. A torch flame is projected into the main combustion chamber 4 through the torch nozzle 5 to burn the lean mixture in the main combustion chamber, during the expansion stroke and beyond. In this manner the engine operates on an overall air-fuel ratio which is very lean.

When the engine is at rest, the interiors of vacuum chambers 34 and 37 of the devices 33 and 44, respectively, rise to atmospheric pressure. The valve closing spring 48 then pushes the operating diaphragm 46 and rod 45 to the right thereby closing the auxiliary choke valve 20. At the same time the spring 42 applies its torque in a direction to close the auxiliary choke valve 20. On the other hand, the valve closing spring 37 within the main vacuum pressure operating device 33 exerts its force through rod 36 against the main choke lever 25 in a direction to close the main choke valve 19. The main choke valve 19 is closed to an extent less then the angle determined by the bimetal 28.

Accordingly, it will be understood that FIG. 1 illustrates the position of the parts when the main choke valve 19 is fully closed. But when the engine ambient temperature is comparatively high and its choke pull-down angle is large, the main choke valve 19 may not be fully closed. If the engine is cranked when its ambient temperature is comparatively low, a mixture considerably richer than that provided during normal operation is produced at the main and auxiliary intake conduits 8A and 10A, and these mixtures are drawn into the main and auxiliary chambers 4 and 6, to accomplish quick starting of the engine. Moreover, as the intake vacuum pressure of the engine rises when cranking, the main and auxiliary choke valves 19 and 20 are opened to a suitable angle by the opening torque of the intake vacuum pressure, and thus the creation of an excessively rich mixture is prevented.

When the engine begins to turn under its own power after starting and when the engine speed has stabilized, the vacuum pressure in the chambers 34 and 47, derived through the orifices 40 and 51 and signal tubes 38 and 49, respectively causes the operating diaphragms 35 and 46 to be pulled back against the force of the valve closing springs 37 and 48. Therefore, the operating rod 36 is separated from the main choke lever 25, and the main choke valve 19 is released from the closing torque applied by force of the spring 37. The choke pulldown angle is simultaneously maintained by means of the bimetal 28. The auxiliary choke lever 41A is moved by the auxiliary choke lever 41B which follows the movement of the operating diaphragm 46. The auxiliary choke valve 20 is thus shifted to the full open position, and the air-fuel ratio of the mixture produced at the auxiliary intake conduit 10A is returned to its normal value. However, since the auxiliary combustion chamber 6 is already heated, because of its comparatively small volume, and the liquid fuel in the intake mixture is rapidly vaporized, the air-fuel ratio inside the auxiliary combustion chamber 6 does not become too lean.

On the other hand, since a mixture is created in the main intake conduit 8A having an air-fuel ratio suitable for warmup of the engine, according to the choke pull-down angle of the main choke valve 19, and since the inside of the control box 27 is heated by the electric heater with the passage of time, the bimetal 28 is thermally deformed. The opening angle of the main choke valve 19 gradually increases, and the air-fuel ratio of the mixture created at the main intake conduit 8A gradually becomes leaner. Consequently, excellent engine warmup is performed.

Figure 2:
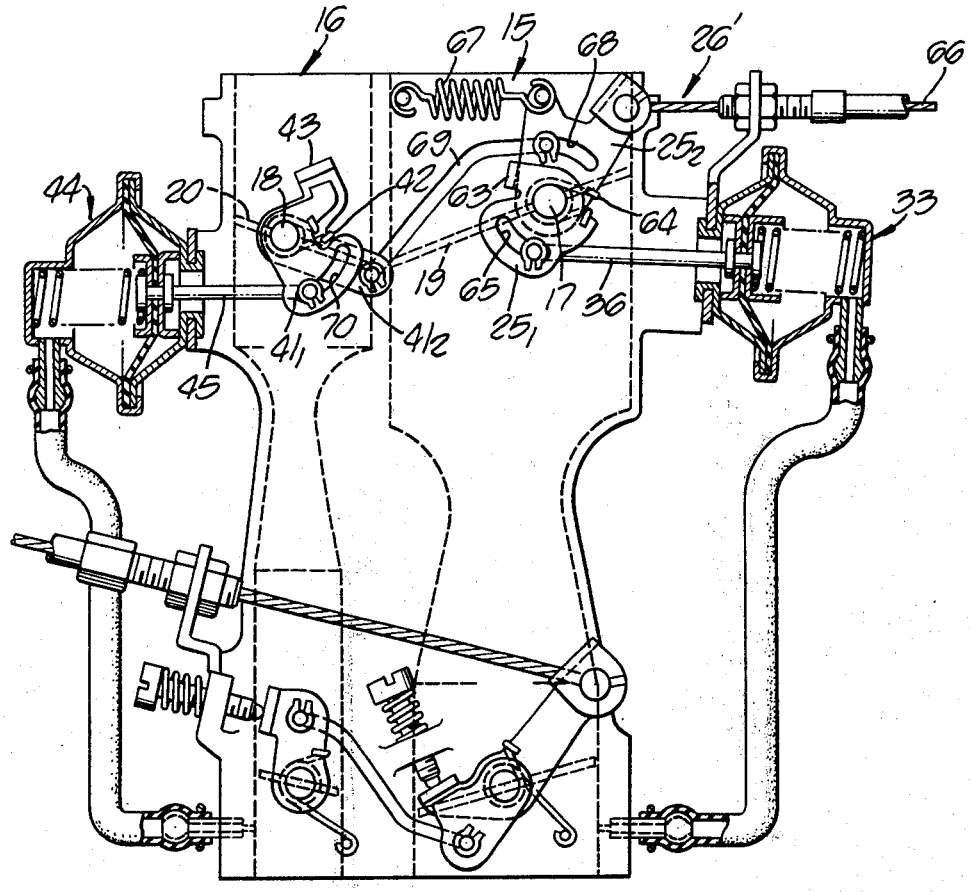
FIG. 2 is a view similar to FIG. 1 showing a modification, and relating to a manually operable choke device.

In the modification shown in FIG. 2, the valve operating mechanism 26' of the main choke valve 19 employs a manual system, and the closing limit of the auxiliary choke valve 20 can be manually adjusted as desired. The main choke lever comprises a primary main choke lever $25_1$ secured to the valve shaft 17, and a secondary main choke lever $25_2$ which is mounted to turn on the shaft 17. This lever $25_2$ contacts one side of the pawl 63 on the lever $25_1$. These levers are coupled together by a torsion spring 64. The projecting end of the operating rod 36 of the main vacuum pressure operating device 33 is slidably coupled to the arcuate slot 65 on the lever $25_1$. Moreover, the operating wire 66 and return spring 67 are connected to the secondary main choke lever $25_2$.

This lever $25_2$ also has an arcuate slot 68, and one end of the operating rod 69 is slidably coupled to this slot 68. The other end is pivotally connected to the auxiliary choke lever $41_2$. An arcuate slot 70 is provided on the primary auxiliary choke lever $41_1$ and this slot slidably receives the projecting end of the operating rod 45 which extends from the auxiliary vacuum pressure operating device 44.

Therefore, when the secondary main choke lever $25_2$ is moved by the return spring 15 in a counterclockwise direction, by relaxation of the tension of the operating wire 66, the lever $25_1$ moves together with the lever $25_2$ because of the coupling force of the connecting spring 64, with the result that the main choke valve 19 is opened to a desired angle. Even if the main choke valve 19 is moved in a counterclockwise direction from fully closed to fully open position, the auxiliary choke valve 20 remains at the fully closed position, because the connecting rod 69 slides on the slot 68.

From the foregoing description it will be understood that the sliding connections between the parts 36 and $25_1$, 69 and $25_2$, and 45 and $41_1$, each constitute an angular lost motion connection.

When the engine turns under its own power, the auxiliary choke valve 20 is fully opened by the auxiliary vacuum pressure device 44 acting through the lever $41_1$. The connecting torsion spring 42 is deformed, and no binding of the secondary auxiliary choke lever $41_2$ occurs. Moreover, the primary main choke lever $25_1$ deforms the connecting torsion spring 64 to a suitable angle by the operation of the main vacuum pressure operating device 33, and the main choke valve 19 is opened to the choke pulldown angle corresponding to the position of the secondary main choke lever $25_2$. That is, the design is such that the force of the spring 64 is balanced with the output of the main vacuum pressure operating device 33 when the connecting spring 64 is deformed to a predetermined angle without being bent fully by the operation of the main vacuum pressure operating device 33.

In other respects the operation of the modified device of FIG. 2 is the same as that described in connection with FIG. 1.

Since the main and auxiliary choke valves 19 and 20, respectively, are installed at the main and auxiliary carburetors 15 and 16, as described above, the engine can be easily started in extremely cold weather by supplying an especially rich mixture to the auxiliary combustion chamber 6. Furthermore, since the auxiliary choke valve 20 is immediately fully opened automatically after the engine turns under its own power, the air-fuel ratio of the mixture within the auxiliary combustion chamber 6 is suitably corrected or reset. This feature together with the formation of vaporization of the fuel by the rapid heating of the small-volume auxiliary combustion chamber 6, produces normal combustion during engine warmup, and the contents of the unburned components of the exhaust gases are reduced.

Having fully described our invention, it is to be understood that we are not to be limited to the details herein set forth but that our invention is of the full scope of the appended claims.

We claim:

1. In a carburetor choke control device for an internal combustion engine into which a rich air-fuel mixture and a lean air-fuel mixture are inducted, the improvement comprising, in combination: a main carburetor for producing a lean mixture, an auxiliary carburetor for producing a rich mixture, a main choke valve in the main carburetor, an auxiliary choke valve in the auxiliary carburetor, a main choke valve closing device connected to said main choke valve to move it toward closed position, an auxiliary choke valve closing device connected to said auxiliary choke valve to move it toward closed position, a main choke valve opening device responsive to engine operation and connected to open said main choke valve to a pulldown angle predetermined by the main choke valve closing device, and an auxiliary choke valve opening device responsive to engine operation and connected to open said auxiliary choke valve fully against the action of said auxiliary choke valve closing device.

2. In a carburetor choke control device for an internal combustion engine into which a rich air-fuel mixture and a lean air-fuel mixture are inducted, the improvement comprising, in combination: a main carburetor for producing a lean mixture, an auxiliary carburetor for producing a rich mixture, a main choke valve in the main carburetor, an auxiliary choke valve in the auxiliary carburetor, an automatic choke valve regulating device connected to the main choke valve for controlling the position of the main choke valve, an auxiliary choke valve regulating device connected to the auxiliary choke valve for controlling the position of the auxiliary choke valve, a main choke valve closing device connected to said main choke valve to move it toward closed position, an auxiliary choke valve closing device connected to said auxiliary choke valve to move it toward closed position, a main choke valve opening device responsive to engine operation and connected to open said main choke valve to a pulldown angle predetermined by the main choke valve closing device, and an auxiliary choke valve opening device responsive to engine operation and connected to open said auxiliary choke valve fully against the action of said auxiliary choke valve closing device.

3. In a carburetor choke control device for an internal combustion engine into which a rich air-fuel mixture and a lean air-fuel mixture are inducted, the improvement comprising, in combination: a main carburetor for producing a lean mixture, an auxiliary carburetor for producing a rich mixture, a main choke valve in the main carburetor, an auxiliary choke valve in the auxiliary carburetor, a manual choke valve regulating device connected to the main choke valve for controlling the position of the main choke valve, an auxiliary choke valve regulating device connected to the auxiliary choke valve for controlling the position of the auxiliary choke valve, said auxiliary choke valve regulating device being connected to the main choke regulating device by a linkage, a main choke valve closing device connected to said main choke valve to move it toward position, an auxiliary choke valve closing device connected to said auxiliary choke valve to move it toward closed position, a main choke valve opening device responsive to engine operation and connected to open said main choke valve to a pulldown angle predetermined by the main choke valve closing device, an auxiliary choke valve opening device responsive to engine operation and connected to open said auxiliary choke valve fully against the action of said auxiliary choke valve closing device, each choke valve opening device having an angular lost motion connection.

4. The combination set forth in claim 3 in which an angular lost motion connection is provided to link both said choke valves for dependent movement.

5. A carburetor choke control device for an internal combustion engine having a main combustion chamber and an auxiliary combustion chamber connected by a torch nozzle, a main carburetor for producing a lean mixture for the main chamber and an auxiliary carburetor for producing a rich mixture for the auxiliary chamber, the improvement comprising, in combination: a main choke valve in the main carburetor, an auxiliary choke valve in the auxiliary carburetor, a choke valve regulating device connected to the main choke valve for controlling the position of the main choke valve, a choke valve closing device connected to said auxiliary choke valve to bias it toward closed position, and a choke valve opening device responsive to engine operation and connected to open said auxiliary choke valve fully against the action of said choke valve closing device.

6. The combination set forth in claim 5 in which the choke valve regulating device includes a bimetal element.

7. The combination set forth in claim 5 in which the choke valve regulating device is manually operated.

8. The combination set forth in claim 5 in which a second valve opening device is provided and is connected to open said main choke valve in response to engine operation.

9. A carburetor choke control device for an internal combustion engine having a main combustion chamber and an auxiliary combustion chamber connected by a torch nozzle, a main carburetor for producing a lean mixture for the main chamber and an auxiliary carburetor for producing a rich mixture for the auxiliary chamber, the improvement comprising, in combination: a main choke valve in the main carburetor, an auxiliary choke valve in the auxiliary carburetor, a main choke valve regulating device connected to the main choke valve for controlling the position of the main choke valve, an auxiliary choke valve regulating device connected to the auxiliary choke valve for controlling the position of the auxiliary choke valve, a choke valve closing device connected to said auxiliary choke valve to bias it toward closed position, a choke valve closing device connected to said main choke valve to bias it toward closed position, and choke valve opening devices responsive to engine operation and connected to open both said choke valves fully against the action of their respective valve closing devices.

10. The combination set forth in claim 9 in which the main choke valve regulating device includes a bimetal element.

11. The combination set forth in claim 9 in which the main choke valve regulating device is manually operated.

12. The combination set forth in claim 11 in which an angular lost motion connection is provided to link both said choke valves for dependent movement.

13. The combination set forth in claim 9 in which an angular lost motion connection is provided in each choke valve opening device.

* * * * *